US005266449A

United States Patent [19]

Däcke et al.

[11] Patent Number: 5,266,449

[45] Date of Patent: Nov. 30, 1993

[54] BLEACHING BATH

[75] Inventors: Christa Däcke, Monheim; Heinrich Odenwälder, Leverkusen; Hans Langen, Bonn, all of Fed. Rep. of Germany

[73] Assignee: Agfa Gevaert AG, Leverkusen

[21] Appl. No.: 969,490

[22] Filed: Oct. 30, 1992

[30] Foreign Application Priority Data

Nov. 13, 1991 [DE] Fed. Rep. of Germany ..... 4137258
Aug. 12, 1992 [DE] Fed. Rep. of Germany ..... 4226651

[51] Int. Cl.[5] ..... G03C 7/28

[52] U.S. Cl. ..... 430/462; 430/393; 430/430; 430/461

[58] Field of Search ..... 430/393, 430, 461, 462

[56] References Cited

U.S. PATENT DOCUMENTS

| | | | |
|---|---|---|---|
| 3,241,966 | 3/1966 | Heilmann et al. | 430/393 |
| 3,615,508 | 10/1971 | Stephen et al. | 430/393 |
| 4,599,427 | 7/1986 | Oeckl et al. | 548/262 |
| 4,914,008 | 4/1990 | Kurematsu et al. | 430/372 |
| 4,960,682 | 10/1990 | Cullinan et al. | 430/393 |

FOREIGN PATENT DOCUMENTS

| | | |
|---|---|---|
| 106243 | 4/1984 | European Pat. Off. . |
| 504609 | 9/1992 | European Pat. Off. . |

*Primary Examiner*—Hoa Van Le
*Attorney, Agent, or Firm*—Connolly and Hutz

[57] ABSTRACT

A bleaching bath for processing of a color photographic silver halide material which contains the ferric complex of alaninediacetic acid as the bleaching agent and in a dye-stabilizing amount a formaldehyde precursor of the formula

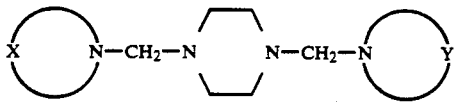

(I)

wherein

X and Y denote the residual atoms of a hetero aromatic 5- or 6-membered ring, yields color photographic images with excellent dye-stabilizing. In the atmosphere above the stabilizing bath no formaldehyde is detectable.

5 Claims, No Drawings

BLEACHING BATH

This invention relates to a new bleaching bath which is suitable for the processing of color photographic silver halide materials and contains as well a bleaching agent as a dye-stabilizer.

In the production of color photographic images, it is necessary to remove the silver image. This can be done by oxidative working bleaching agents, customarily iron complex salts, in the presence of a halide ion, followed by treating the material with a silver halide solvent, commonly referred to as a fixing agent. Alternatively, bleaching and fixing can be combined to a one step treatment, which is the bleach-fixing.

A wide variety of aminopolycarboxylic acids are recommended as complexing agents for the iron complex salts, e.g. ethylenediamine tetraacetic acid (EDTA), proplenediamine tetraacetic acid (PDTA), diethylenetriamine pentaacetic acid (DTPA) and alaninediacetic acid (ADA). Corresponding patents are U.S. Pat. No. 3,241,966, 3,615,508 and 3,767,401.

It is further known to use a stabilizing bath as the last step in a color photographic processing before drying to stabilize the dye-stuffs and to avoid stain. This is done as well for color photographic films as for color photographic paper. A wide variety of different dye-stabilizing compounds and combinations has been suggested. A survey is disclosed in U.S. Pat. No. 4,960,682.

The predominantly used stabilizer is formaldehyde to provide enhanced magenta dye stability. The formaldehyde reacts with unreacted coupler and prevents thereby the undesired reaction of the unreacted coupler with the magenta dye. Formaldehyde in its pure form is undesired from an ecological standpoint. Therefore, it has been suggested to replace formaldehyde by formaldehyde precursors. Further, it has been suggested to add the formaldehyde precursor to a bleaching bath to avoid the stabilizing bath totally (U.S. Pat. No. 4,960,682).

This method is only suitable for separated bleaching and fixing. Bleach-fixing is excluded.

As suitable formaldehyde precursors a number of methylol compounds are suggested which are on the one hand in aqueous solution in an equilibrium with free formaldehyde but on the other hand the concentration of the free formaldehyde is very low so that there is no effect on the environment. Known methylol compounds are methylolated ureas, guanidines and melamines further 1,3-dimethylol-5,5-dimethylhydantoin, formaldehyde bisulfite and hexamethylene tetramines.

All these compounds are disadvantageous because either they cannot provide fast enough formaldehyde which is consumed by the reaction with the color coupler or they lead to a concentration of formaldehyde above the bleach stabilizing bath which cannot be tolerated.

It is an object of the invention to provide a formaldehyde precursor which can be used in the bleaching bath, the equilibrium relationship of it in aqueous solution is predominantly on the side of the precursor and not on the side of the free formaldehyde. Further the adjustment of the equilibrium after consumption of the free formaldehyde should be very fast.

It has been found surprisingly that the foregoing objects can be achieved by a combination of compounds of the formula

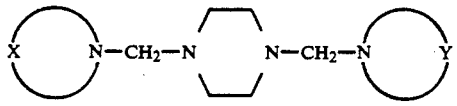

(I)

wherein

X and Y represent the residual atoms of a heteroaromatic 5- or 6-membered ring together with the iron(III)-complex of alaninediacetic acid (ADA).

X and Y represent together with the nitrogen atom for instance 1,2,3-triazolyl-(2), 1,2,4-triazolyl-(1), pyrazolyl and imidazolyl.

The compound wherein X and Y together with the nitrogen atom represents 1,2,4-triazolyl-(1) is preferred. This compound is known from EP 106 243.

The invention therefore refers to a bleach-stabilizing bath which beside the iron(III)-complex of alaninediacetic acid as bleaching agent contains in a dye-stabilizing amount a formaldehyde precursor of formula I.

Customarily the dye-stabilizing effect is achieved with 0.1 to 20 g of the compound of formula I in 1 l bleach-stabilizing bath, preferably 2 to 10 g/l.

The amount of bleaching agent is preferably 10 to 400 g/l, particularly 20 to 150 g/l in this bath.

The bleaching bath can be used in a color negative process as well as in a color reversal process. Both processes have a dye-developing step before the bleach-stabilizing step and a fixing after the bleach-stabilizing step. In the color reversal process there is additionally a first development bath and a reversal bath before the color development bath.

A color negative film containing magenta coupler A was processed by the color negative processing called Agfacolorproze$\beta$70 with the following steps:

Color developing
Bleaching
Fixing
Washing
Stabilizing
Drying.

Bleaching baths 1 and 2 were used. The customarily stabilizing bath of Example 1 contained 0.5 g/l formaldehyde and a wetting agent. The stabilizing bath of Example 2 contained only a wetting agent. Example 3 contained no stabilizing bath at all.

| | | |
|---|---|---|
| Bleaching bath 1: | iron ADA | 53.85 g |
| | ammonium bromide | 62.6 g |
| | ADA | 12 g |
| | ammonium nitrate | 3 g |
| | water to 1 l | |
| Bleaching bath 2: | iron ADA | 53.85 g |
| | ammonium bromide | 62.6 g |
| | ADA | 12 g |
| | ammonium nitrate | 3 g |
| | compound (1) | 6 g |
| | water to 1 l | |

Compound (1):

-continued

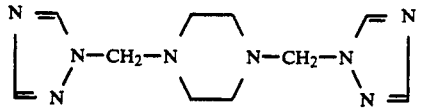

Coupler A:

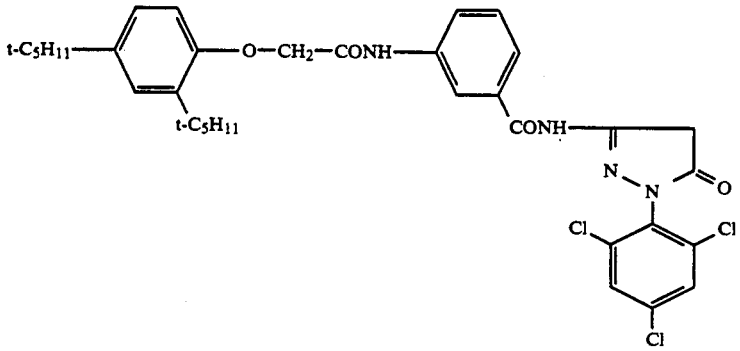

Measurements were made of the amount of residual unreacted magenta coupler by chromatography, the percentage change of the magenta density after a 7 days storage at 80° C. and 50% relative moisture and the concentration of formaldehyde above the bath. The results are reported in Table 1 below.

TABLE 1

| Example | Bleaching bath | percentage unreacted coupler | percentage change in magenta density | formaldehyde in vapor (μg/500 ml) | |
|---|---|---|---|---|---|
| 1 | 1 | 0 | −11 | 2 | comparison |
| 2 | 1 | 100 | −21 | 0 | comparison |
| 3 | 2 | <2 | −2 | —* | invention |

*below the detection limit

Example 1 shows that the residual coupler reacts totally with formaldehyde but the dye stability is insufficient. There is an undesirably high concentration of formaldehyde above the bath.

According to Example 2 in which no formaldehyde was used the residual coupler is unreacted, there is no formaldehyde in the atmosphere above the bath but the dye stability is insufficient.

With the formaldehyde precursor of the invention the residual coupler is largely reacted, there is no formaldehyde detectable above the bath and the dye stability is improved.

We claim:

1. Bleaching bath for a color photographic silver halide material which contains the iron(III)-complex of alaninediacetic acid as bleaching agent and in dye-stabilizing amount a formaldehyde precursor of the formula

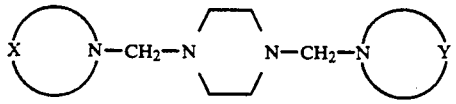

(I)

wherein

X and Y are the residual atoms of a hetero-aromatic 5- or 6-membered ring.

2. Bleaching bath according to claim 1 wherein the formaldehyde precursor is represented by the formula

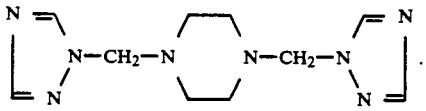

3. Bleaching bath according to claim 1 containing 10 to 400 g/l of the bleaching agent and 0.1 to 20 g/l of the formaldehyde precursor.

4. A method for processing an imagewise exposed color photographic silver halide element by color development, bleaching and fixing wherein bleaching is performed with a bleaching bath according to claim 1.

5. A method according to claim 4 excluding stabilizing after fixing.

* * * * *